US006040519A

United States Patent [19]

Kita et al.

[11] Patent Number: 6,040,519

[45] Date of Patent: Mar. 21, 2000

[54] UNIT SHEATH

[75] Inventors: Hideki Kita; Hideo Kawamura, both of Kanagawa-ken, Japan

[73] Assignee: Isuzu Ceramics Research Institute Co., Ltd., Kanagawa-ken, Japan

[21] Appl. No.: 09/166,564

[22] Filed: Oct. 6, 1998

[30] Foreign Application Priority Data

Nov. 21, 1997 [JP] Japan ..... 9-336546

[51] Int. Cl.[7] ..... H01L 35/02

[52] U.S. Cl. ..... 136/230; 136/227; 219/205; 219/267

[58] Field of Search ..... 136/234, 230, 136/227, 226; 374/179, 208; 219/205, 267

[56] References Cited

U.S. PATENT DOCUMENTS 5,696,348 12/1997 Kawamura et al. ..... 136/230

FOREIGN PATENT DOCUMENTS 6019404 5/1985 Japan .

7217886 8/1995 Japan .

*Primary Examiner*—Kathryn Gorgos
*Assistant Examiner*—Thomas H Parsons
*Attorney, Agent, or Firm*—Browdy and Neimark

[57] ABSTRACT

The present invention provides a unit sheath adaptable to a glow plug or a thermocouple, which is improved in durability by the protection from burn-out of the conductive filament. The unit sheath is preferably adapted to a glow plug 10. A protective envelope 1 of ceramics high in density includes a metallic filament 4 of any one of pure tungsten, molybdenum or alloy thereof. A high-density sealant 3 hermetically closes the envelope 1 at its opened end 5. Filler 2 of non-conductive, unburned material is packed in the space around the metallic filament 4 in the envelope 1. The filler contains therein an additive 7 that may be subjected to the oxidation at the temperature lower than that of the metallic filament 4. The additive 7 is composed of at least any one of a free oxygen absorber selected from the group of carbon, titanium, boron, aluminum and nitride thereof, or the mixture thereof.

11 Claims, 4 Drawing Sheets

UNIT SHEATH

BACKGROUND OF THE INVENTION

1. Field of the Invention

The present invention relates to a unit sheath suitable to be employed in glow heaters, thermocouples and heat-exchanger tubes.

2. Description of the Prior Art

It is well known that the sheathing parts made of metals such as stainless steel or the like have been used in the envelopes for the metallic glow plugs and the sheathed-type thermocouples subjected to high temperature. The sheathing parts used in the atmosphere at more than 1000° C. have been conventionally made of special heat resisting alloy such as INCONEL (trademark for a Ni—Cr—Fe alloy). The sheathing parts of ceramics have been developed for the glow plugs, or glow heaters, equipped in the compression-ignition or firing means in diesel engines, and also for the thermocouples for accurate temperature measurement of the high temperature gases and liquids. The prior thermocouples have been designed so as to be capable of making the temperature measurement in the range of from 300° C. to 1400° C.

On fabricating the prior glow heater disclosed, for example, in Japanese Patent Laid-Open No. 217886/1995, the outer shell of $Si_3N_4$ is filled with a molding in which a tungsten coil is wrapped with clay material for inner shell containing Si and Ti therein. The unit shell is then burned with chemical reaction, resulting in improvement in the adherence between the outer and inner shells.

Disclosed in Japanese Patent Publication No. 19404/1985 is a heater fabricated by the steps of, embedding a heating element of metal having the high melting point, such as tungsten, molybdenum or the like, in a molding of silicon nitride, burning the silicon nitride by hot pressing simultaneously with integration of the silicon nitride with the heating element. Moreover, the prior sheathed glow plug disclosed in the above-cited No. 19404/1985, in which a coiled heating element and a resisting element, connected continuatively with each other, are arranged between the central electrode and the closed bottom of the tube made of heat resisting metal, and further the winding pitch of the resisting element is varied such that it is high at the part adjacent to the electrode and is low at the part on the side of the heating element.

In the method of fabricating the heater, it is well known that a coiled metal high in melting point covered with powdered silicon is inserted in the protective envelope of silicon nitride, and the assembly is subjected to burning with chemical reaction in nitrogen atmosphere.

It is well known, however, that tungsten or alloy thereof used in the prior heaters undergoes at the temperature of 1100° C. or higher a change called recrystallization causing brittleness of metals. Any of the prior fabrication processes for the heater should require at the burning step thereof the temperature in the range of from 1400° C. to 1900° C., and thus the heating elements become brittlen that results in the main cause of burn-out of the heating elements. The prior fabrication processes require the expensive furnace and complicated steps with the result of the higher production cost. Because the heating elements are ordinarily subjected to the oxidation at the temperature of 600° C., the prior heaters have had shortcoming such that the durability of heating elements is reduced by the oxidation due to oxygen trapped in the porous material packed in the protective envelope.

SUMMARY OF THE INVENTION

An object of the present invention is to overcome the shortcomings as described above with reference to the prior art, and to provide a unit sheath in which an envelope of heat resisting material has received therein a metallic filament of pure tungsten or alloy thereof, and the envelope is further packed with a filler containing an additive of carbon or the like that may be subjected to the oxidation at the temperature lower than that of tungsten so that the carbon may predominantly react with oxygen invading the envelope whereby the metallic filament of tungsten or the like is protected for the oxidation, resulting in prolonging the durability of the metallic filament.

Another object of the present invention is to provide the unit sheath composed of the protective envelope of ceramics high in density, the envelope being opened at its one end and closed at its opposing end, a metallic filament of pure tungsten, molybdenum or alloy thereof received in the envelope, a high-density sealant of any one of glass and heat resisting synthetic resin for hermetically closing the envelope at the opened end, and including a filler of non-conductive, unburned material packed in the space around the metallic filament in the envelope, the filler containing therein an additive that may be subjected to the oxidation at the temperature lower than that of the metallic filament, resulting in the deoxidation in the envelope.

An additional object of the present invention is to provide a unit sheath in which the additive of free oxygen absorber is of at least any one selected from the group of carbon, titanium, boron, aluminum and the nitride thereof, or of the mixture thereof.

A further object of the present invention is to provide a unit sheath in which the amount of the additive is not more than 50% by weight with respect to the total weight of the filler.

Another object of the present invention is to provide a unit sheath in which the burned material for the filler is composed of a composite of powdered silicon nitride with inorganic compound particles which are interposed among particles of the powdered silicon nitride, the inorganic compound particles being formed from any one of organo-silicic polymer and alkoxide.

Another object of the present invention is to provide a unit sheath in which the protective envelope is composed of any one of silicon nitride, silicon carbide, SiAlON and composite thereof.

Another object of the present invention is to provide a unit sheath adapted to a glow plug in which the metallic filament is for a heating element and the envelope is supported in a housing.

A further object of the present invention is to provide a unit sheath adapted to a thermocouple in which the metallic filament is made of tungsten-rhenium alloy and the envelope is mounted in a supporting tube.

Another object of the present invention is to provide a unit sheath adapted to a thermocouple in which the envelope is coated with a layer of any one of Mo—ZrN and Mo—$ZrB_2$ by the thermal spraying.

A further object of the present invention is to provide a unit sheath in which the glass for the sealant contains boron therein and the heat resisting synthetic resin is of silicone rubber.

According to the unit sheath of the present invention as described above, the additive of carbon or the like serving as a free-oxygen absorber may be predominantly oxidized with oxygen in the filler to thereby make the free-oxygen atmosphere of the filler, where the metallic filament in the envelope is protected from the oxidation and thus its durability may be extended. On the unit sheath being adapted to the glow plug, the switching-on of the metallic filament causes heating of unburned material of the filler in the envelope whereby the powdered silicon nitride and the polycarbosilane are burnt to be converted into the inactive sintered body as well as the oxidation of the carbon by oxygen in the filler is promoted. Alternatively, in case the unit sheath is adapted to the thermocouple, the unburned material is also burnt by the heat of the object to be measured, and becomes inactive in the form of the sintered body.

The unit sheath of this invention is remarkably superior in durability, since the metallic filament is protected by the envelope of the heat-proof and corrosion-proof properties and is positively held in the envelope by the filler that has increased in density. The thermocouple with the unit sheath of this invention may ensure the accurate temperature measurement with stability and reliance, especially, on high temperature measurement in the oxidation-reduction atmosphere. The envelope of the unit sheath according to this invention may provide the thermocouple, which is improved in corrosion resistance even in the sulfuric acid gas, little variation in the thermal electromotive force and much longer in durability.

Alternatively, the envelope of the unit sheath according to this invention may provide the glow heater, which is remarkably increased in service times, or turn-on times, at the saturation temperature of 1000° C., resulting in the prolongation in durability. That is, the present invention may provide the glow heater which ensures the steady firing of fuel as well as minimizes the risks of corrosion in the envelope and burn-out in the metallic filament due to the oxidation.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DETAILED DESCRIPTION OF THE PREFERRED EMBODIMENTS

Figure 1:
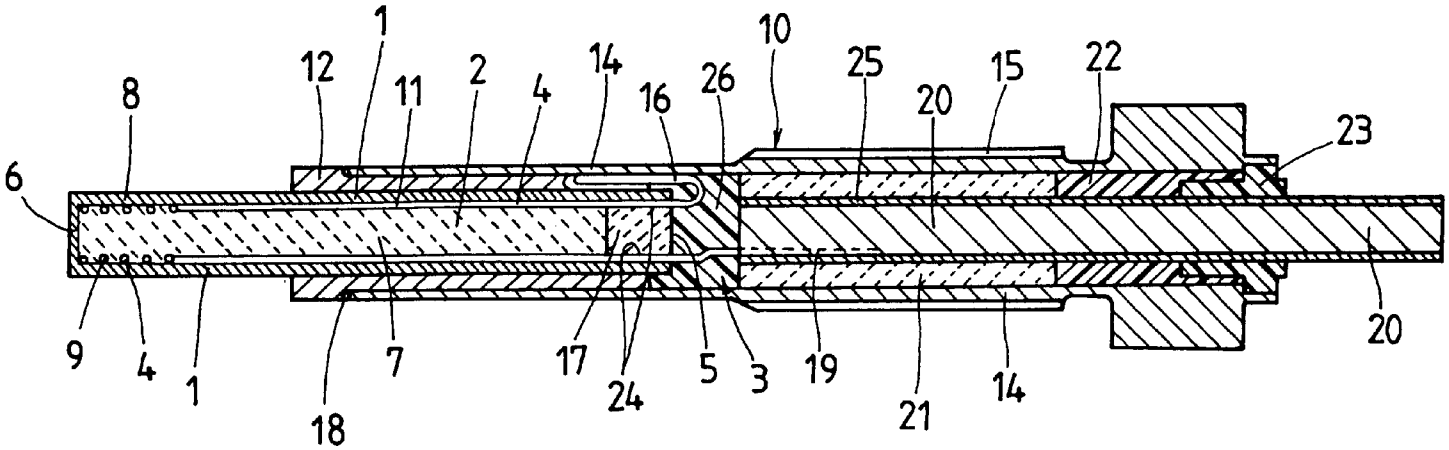
FIG. 1 is a longitudinal sectional view showing a first preferred embodiment of the unit sheath according to the present invention, which is adapted to a glow plug.
Figure 2:
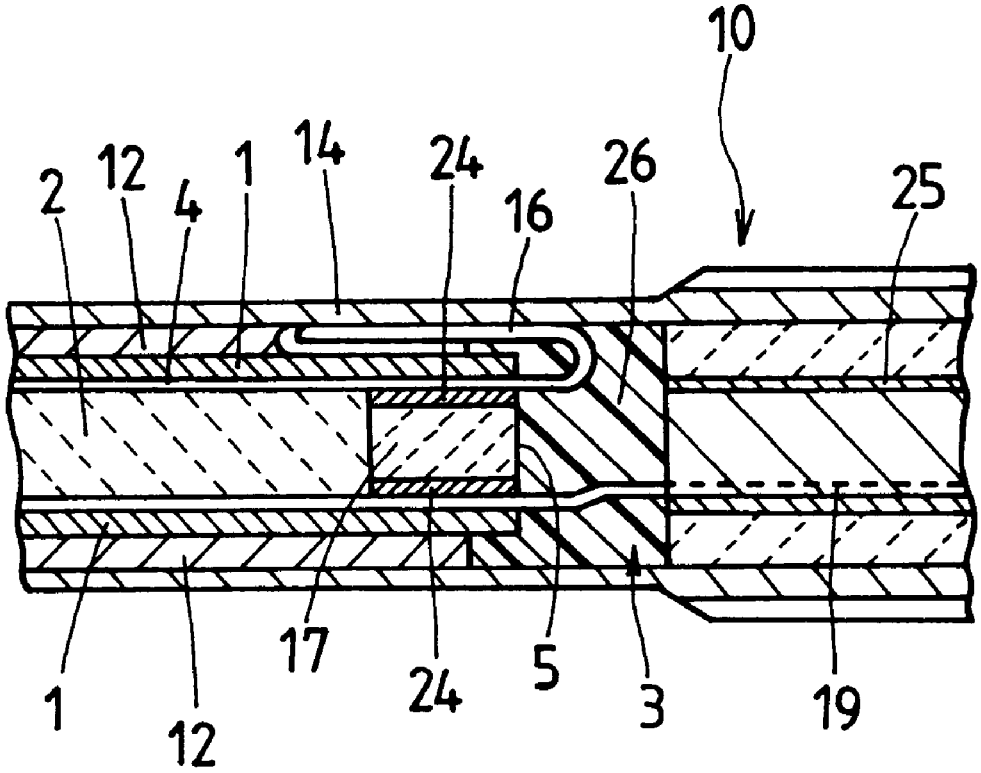
FIG. 2 is a fragmentary enlarged sectional view of a glow plug shown in FIG. 1.

Peferring now in detail to the drawings, the embodiments of the unit sheath according to the present invention will be explained below. It will be noted that the unit sheath of the present invention is preferably adapted to a glow plug shown in FIG. 1 or the thermocouple shown in FIG. 3.

A glow plug 10 having incorporated with the unit sheath of this invention is to be adapted to compression-ignition or firing in diesel engines. A metallic filament 4 of pure tungsten or tungsten alloy is held in a protective envelope 1 to be free from oxygen, which causes the oxidation of the filament.

The unit sheath adapted to the glow plug 10 is, primarily, composed of the protective envelope 1 of ceramics high in density, the envelope 1 being opened at its one end 5 and closed at its opposing end 6, the metallic filament 4 of pure tungsten, molybdenum or alloy thereof received in the envelope 1, and a sealant of any one of glass and heat resisting synthetic resin for hermetically closing the envelope 1 at the opened end 5. The unit sheath further includes a filler of non-conductive, unburned material packed in the space around the metallic filament 4 in the envelope 1, the filler containing therein an additive that may be subjected to the oxidation at the temperature lower than that of the metallic filament 4, resulting in the deoxidation in the envelope 1.

The protective envelope 1 is made of any one of silicon nitride, silicon carbide, SiAlON and composite thereof. The sealant 3 is composed of glass members 24, a plug member 17 of silicon nitride and a heat resisting synthetic resin member 26. The glass members 24 of the sealant 3 contain $B_2O_3$ and ZnO therein. The heat resisting synthetic resin member 26 in the sealant 3 is of silicone rubber. According to this invention, the glow plug 10 in which the unit sheath is employed as the protective envelope 1 is packed with the filler 2 having embedded the metallic filament 4 therein. It will be noted that the metallic filament 4 is composed of, for example, a coiled wire 9 for a heating part and linear wire sections for electrically-resisting parts 11.

The following discloses the details of the glow plug 10.

The metallic tube 12 of carbon steel is fixed on the periphery of the protective envelope 1 by means of activated silver brazing filler metal in such a manner that the heating part 8 is exposed. Welded at 18 on the periphery of the metallic tube 12 is a metallic pipe 14 that provided with threads 15 for securing the glow plug 10 to the cylinder head or the like of engines. An electrode 20 is received in the metallic pipe 14 such that it is in contact with at its one end with the sealant 3 closing the envelope 1 and extends over the metallic pipe 14. The electrode 20 is covered with a coating layer 25 of fluorocarbon resin, or teflon. An annular space defined between the electrode 20 and the metallic pipe 14 is packed with insulating material 21 of powdered $Al_2O_3$ for electric and heat insulation. Fitted in the open end of the metallic pipe 14 are closures of epoxy plastics 22 and phenol resin plastics 23 for closing thereby the insulating material 21. The metallic filament 4 is secured at its one end 19 to the electrode 20 by welding and short-circuited to the metallic pipe 14 at its other end coated with a tube 16 of kovar (Fe—Ni—Cr-alloy).

The filler 2 of unburned material packed in the protective envelope 1 is composed of a composite of powdered silicon nitride with inorganic compound particles that are formed from organo-silicic polymer or alkoxide. The composite has such structure that the particles of inorganic are interposed among particles of powdered silicon nitride. The protective envelope 1 is closed at its open end 5 with a plug member 17 of silicon nitride, the periphery of which is hermetically sealed by mean of the glass members 24 containing $B_2O_3$ and ZnO therein. The filler 2 is mixed with at least one of the additive 7 for the free oxygen absorber, selected from the group of carbon, titanium, boron, aluminum, nitride thereof and the mixture thereof. Thus, the filler mixed with the additive is packed in the protective envelope 1. According to the preferred embodiment, for example, the filler 2 may be composed of a mixture of powdered $Si_3N_4$ and polycarbosilane with the additive of carbon. It is to be noted with consideration of durability that the amount of the additive 7 should be not more than 50% by weight with respect to the total weight of the filler 2. The residual oxygen in the envelope 1 may predominantly react with the additive 7 so that the metallic filament 4 is prevented from oxidation.

The following discloses how to fabricate the glow plug 10 as described above. In the following example, the protective envelope 1 made of silicon nitride was used. An envelope 1 made of $Si_3N_4$, 2.5 mm in inner diameter, 3.5 mm in outer diameter, 40 mm long, was packed with a slurry having the compounding ratio of 55 wt % toluene solution containing 44 wt % powdered $Si_3N_4$ and 40 wt % poly-carbosilane, and 1 wt % carbon. A metallic filament 4 of 0.2 mm linear was inserted in the envelope 1. After connection of the metallic filament 4 to lead wire, the slurry was heated up to 120° C. at maximum to thereby volatilize the solvent. Thereafter, the open end 5 of the envelope 1 was closed with the plug member 17 of $Si_3O_4$ and the heat resisting glass member 24. Furthermore, the heat resisting resin member 26 of silicone rubber made the hermetic seals at the end of the envelope 1 whereby the heater element was completed. Brazing the metallic tube and pipe 12, 14 to the heater element resulted in the glow plug 10.

Figure 3:
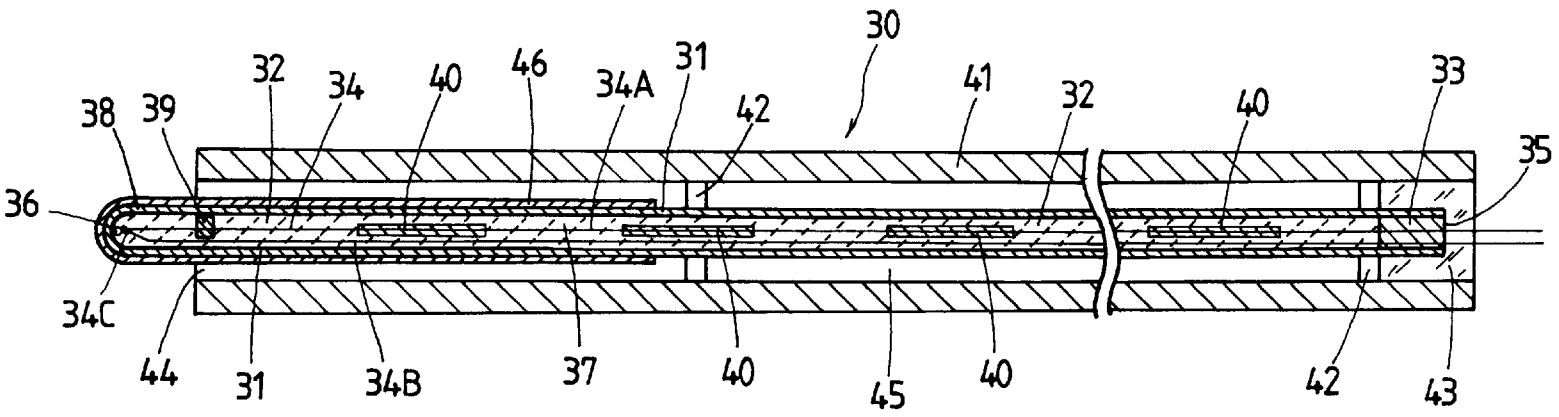
FIG. 3 is a longitudinal sectional view showing another embodiment of the unit sheath according to the present invention, which is adapted to a thermoelectric couple.
Figure 4:
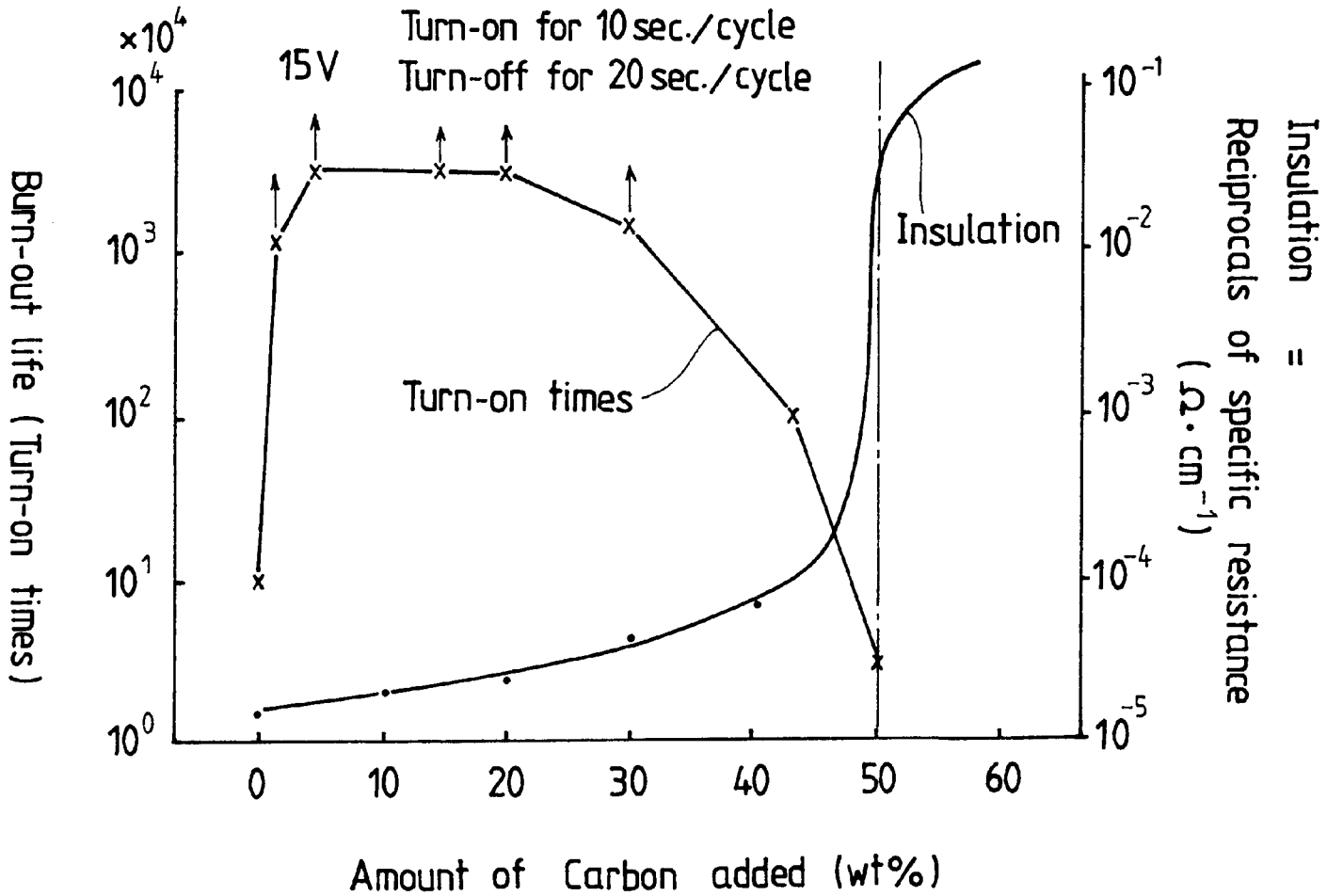
FIG. 4 is a graph illustrating the relation of burn-out life with amount of carbon added.

Next, referring to FIGS. 3 and 4, there is shown another embodiment of the present invention applied to a thermoelectric couple.

The unit sheath incorporated in a thermocouple 30 has the constitution substantially identical with the structure employed in the glow plug 10. The thermoelectric couple 30 has a metallic filament 34 arranged in a protective envelope 31 that is opened at its one end 35 and also closed at its opposed end 36, and packed with a filler 32. The protective envelope 1 is made of any one of silicon nitride, silicon carbide, SiAlON and composite thereof, just like the embodiment for the glow plug 10. The metallic filament 34 is composed of tungsten-rhenium alloys. The metallic filament 34 consists of two types of conductive wire sections of non-uniform composition, one 34A of which is of W-5% Re alloy, the other 34B being of W-26% Re alloy. The wire sections 34A and 34B are connected with each other at a junction 34C located in a temperature measurement zone 38. The wire sections 34A and 34B for the metallic filament 34 are held in electrically insulated relation from each other in the envelope 1 by means of a supporting member 39 of mullite, $Al_6Si_2O_{13}$. Any one of the filament sections 34A and 34B, further, passes through pipe sections 40 of mullite at locations spaced from each other, so that the filament sections 34A and 34B are electrically isolated from each other and thus prevented from short-circuiting.

Moreover, provided on the surface of the envelope 31 is a layer 46 of thermal spray-coating of any one of Mo—ZrN and Mo—$ZrB_2$ for protection of the envelope 31 from adhesion of molten metal such as iron. The envelope 31 is made of an elongated tube having the relatively smaller diameter and protected by a supporting tube 41 of relatively larger diameter. That is, the envelope 31 is kept in the supporting tube 41 of cermet (Mo—$ZrO_2$) by a supporting ring 42 in such a manner that the temperature measurement zone 38 of the envelope 31 protrudes out of the envelope 31 and an annular air spacing is formed between the envelope 31 and the supporting tube 41.

The supporting tube 41 is opened at its end 44 on the side of the temperature measurement zone 38 of the envelope 31. The supporting tube 31 is closed at its other end with a sealing member 43 of glass solidified dehydrated polymerization reaction, for example, phosphate glass containing powdered MgO. On the other hand, a sealant makes a hermetic seal 33 at the opened end 35 of the envelope 31. The glass containing $B_2O_3$ and ZnO has the thermal conductivity of $4\times10^{-6}$/° C. and the heat-resisting temperature of 650° C. Upon the thermocouple 30 being immersed in the object, the temperature of which is to be measured, such as molten bath, the heat-insulating layer may be provided by the air 45 confined between thesealing member 43 and molten bath blocking the opened end 44 of the supporting tube 41. It will be thus understood that the heat-insulating layer of air may protect the filament sections from the external thermal influence to thereby ensure accurate measurement at the temperature measurement zone.

The filler 32 of unburned material packed in the protective envelope 31, like the first embodiment for the glow plug, is composed of a composite of powdered silicon nitride with inorganic compound particles that are formed from organosilicic polymer or alkoxide. The composite has such structure that the particles of the inorganic compound are interposed among the particles of the powdered silicon nitride. The filler 32 is mixed with at least one additive 37 for free oxygen absorber, selected from the group of carbon, titanium, boron, aluminum, nitride thereof and the mixture thereof. Thus, the filler is packed in the protective envelope 31. According to this preferred embodiment, for example, the filler 32 may be composed of a mixture of powdered $Si_3N_4$ and polycorbosilane with the additive of carbon. It is to be noted with consideration of durability that the amount of the additive should be not more than 50% by weight with respect to the total weight of the filler 32. The residual oxygen in the envelope 31 may predominantly react with the additive 37 so that the metallic filament 34, or filament sections 34A and 34B, is effectively protected from oxidation.

The following discloses how to fabricate the thermocouple 30 described above. In the following example, the protective envelope 31 made of silicon nitride was used. An envelope 31 made of $Si_3N_4$, 5 mm in outer diameter, 3 mm in inner diameter, 300 mm long, was packed with a slurry having the compounding ratio, substantially identical with that in the fabricating process for the glow plug 10. Inserted in the envelope 31 was the metallic filament 34 of the W-5% Re filament section 34 A and the W-26% Re section 34B, each of 0.5 mm linear, 300 mm or longer in length, welded with each other at their adjacent ends. Then, the open end 35 of the envelope 31 was closed with the plug member 33 of heat resisting glass. Furthermore, the hermetically sealed envelope 31 was applied with the layer 46 of thermal spray-coating of any one of Mo—ZrN and Mo—$ZrB_2$. Moreover, the envelope 31 was held in the supporting tube 41 whereby the thermocouple 30 was completed.

On temperature measuring of molten bath for cast iron at about 1450° C. by the thermocouple 30 having been fabricated as described above, it took about 5 seconds till the electric equilibrium between the dissimilar metals had been established. The thermocouple 30 produced the electromotive force of 15 voltages for a measuring cycle of immersion in molten bath for 10 seconds and withdrawal out of molten bath for 20 seconds. After the thermocouple 30 made repeatedly the temperature measurements of the molten bath for 500 cycles, inspection of the thermocouple 30 shows no crack in the envelope 31, no deterioration in measurement performance and no generation of adverse condition. Following the measurements of 500 cycles described in the above, the same thermocouple 30 made further measurements in the molten bath over 1200 cycles, there is nevertheless no change in the electromotive force as well as the accurate measurement was ensured. The experimental results described above are illustrated in FIG. 4.

Finally referring to FIG. 4, the abscissa is the amount (wt %) of carbon added, and the ordinate is turnon times at which the metallic filament 34 burnt out and insulation that is reciprocals of specific resistance ($\Omega \cdot cm^{-1}$). As will be understood from FIG. 4, the amount of carbon added should be limited to 50 wt % and the addition of carbon within several percentages is effective in protection of the metallic filament 34 from the oxidation, resulting in minimizing the risk of burn-out of the filament 34.

It should be understood that the foregoing relates to only preferred embodiments of the present invention, and that is intended to cover all changes and modifications of the examples of the invention herein chosen for the purposes of the disclosure, which do not constitute departure from the spirit and scope of the invention.

What is claimed is:

1. A unit sheath comprising a protective envelope of ceramics high in density, the envelope being opened at its one end and closed at its opposing end, a metallic filament of any one of pure tungsten, molybdenum and alloy thereof received in the envelope, a high-density sealant of any one of glass and heat resisting synthetic resin for hermetically closing the envelope at the opened end, and a filler of non-conductive, unburned material packed in the space around the metallic filament in the envelope, the filler containing therein an additive that may be subjected to the oxidation at the temperature lower than that of the metallic filament, resulting in the deoxidation in the envelope.

2. A unit sheath according to claim 1, wherein the additive of free oxygen absorber is of at least any one selected from the group of carbon, titanium, boron, aluminum, the nitride thereof and the mixture thereof.

3. A unit sheath according to claim 1, wherein an amount of the additive is not more than 50% by weight with respect to the total weight of the filler.

4. A unit sheath according to claim 1, wherein the un-burned material for the filler is composed of a composite of powdered silicon nitride with inorganic compound particles which are interposed among particles of the powdered silicon nitride.

5. A unit sheath according to claim 4, wherein the inorganic compound particles formed from any one of organosilicic polymer and alkoxide.

6. A unit sheath according to claim 1, wherein the envelope is composed of any one of silicon nitride, silicon carbide, SiAlON and composite thereof.

7. A unit sheath according to claim 1, adapted to a glow plug in which the metallic filament is for a heating element and the envelope is supported in a housing.

8. A unit sheath according to claim 1, adapted to a thermocouple in which the metallic filament is made of tungsten-rhenium alloy and the envelope is mounted in a supporting tube.

9. A unit sheath according to claim 1, wherein the envelope for the thermocouple is coated with a layer of any one of Mo—ZrN and Mo—$ZrB_2$ by the thermal spraying.

10. A unit sheath according to claim 1, wherein the glass of the sealant contains boron therein.

11. A unit sheath according to claim 1, wherein the heat resisting synthetic resin is of silicone rubber.

* * * * *